US005611677A

United States Patent [19]

Salama

[11] Patent Number: 5,611,677

[45] Date of Patent: Mar. 18, 1997

[54] RIVER PUMP DEVICE

[76] Inventor: Eqdam Y. Salama, Box 136, Jeddah 21411, Saudi Arabia

[21] Appl. No.: 584,100

[22] Filed: Jan. 11, 1996

[51] Int. Cl.[6] ..... F04B 17/00

[52] U.S. Cl. ..... 417/336; 239/542; 416/189

[58] Field of Search ..... 417/334, 336, 417/407, 409; 239/542; 416/189 A

[56] References Cited

U.S. PATENT DOCUMENTS

| | | | |
|---|---|---|---|
| Re. 28,095 | 7/1974 | Chapin | 239/542 X |
| 988,735 | 4/1911 | Perry | 416/189 A |
| 2,382,412 | 8/1945 | Grey et al. | 417/407 X |
| 2,694,979 | 1/1954 | Lauck | 417/409 X |
| 3,797,741 | 3/1974 | Spencer | 239/542 X |
| 4,205,943 | 6/1980 | Vauthier | 416/189 A X |
| 5,353,993 | 10/1994 | Rosenberg | 239/542 |

FOREIGN PATENT DOCUMENTS

| | | | |
|---|---|---|---|
| 725958 | 5/1932 | France | 417/336 |

*Primary Examiner*—Richard E. Gluck
*Attorney, Agent, or Firm*—Michael I. Kroll

[57] ABSTRACT

A river pump device (10) comprising a first conduit (12) immersed in a river (14), to receive water (16) from the river (14). A second conduit (18) carries the water (16) away from the river A mechanism (20) immersed in the river (14) is operable by the kinetic force of the water (16) flowing in the river (14), for moving the water (16) out of the first conduit (12) into the second conduit (18). An irrigation tube (22) is transversely coupled to a distal end of the second conduit (18). The irrigation tube (22) has a plurality of small holes (24) therealong to supply the water (16) onto dry land (26), so that vegetation (28) will thrive.

17 Claims, 2 Drawing Sheets

RIVER PUMP DEVICE

BACKGROUND OF THE INVENTION

1. Field of the Invention

The instant invention relates generally to irrigation systems and more specifically it relates river pump device.

2. Description of the Prior Art

Numerous irrigation systems have been provided in prior art that are adapted to supply dry land with water by artificially diverting the water by using ditches, pipes or streams, so that plant and animal life will flourish. While these units may be suitable for the particular purpose to which they address, they would not be as suitable for the purposes of the present invention as heretofore described.

SUMMARY OF THE INVENTION

The instant invention relates to an outstanding new innovation designed to provide a free source of power for pumping water from a river to an area where it can be used for other purposes such as irrigation. The device is unique in that it utilizes river power to pump the water to different areas. In doing so, it provides a pollution free low cost operation. When water is not needed, it can be diverted back to the river through a suitable connection of a pipe and valve.

In many locations, there is plenty of water available but it is often in the wrong area or expensive to pump from one place to another. The device uses the flow of river water to power and operate a pump and in turn pumps the water to a place where it is needed. It will operate twenty four hours a day to supply unlimited amounts of fresh water for irrigation purposes. It is an invention which will fill a need not only here in the United States, but worldwide as well. It offers a practical and extremely effective system which will be easy to use and provide years of trouble free service. The river pump device will provide pollution free pumping of river water to surrounding land areas for twenty-four hours a day at no cost of operation.

A primary object of the present invention is to provide a river pump device that will overcome the shortcomings of the prior art devices.

Another object is to provide a river pump device that will utilize a free source of power, which is kinetic energy of flowing water in a river for pumping the water out from the river to a land area, for the purpose of irrigating the land area.

An additional object is to provide a river pump device, in which a pollution-free low cost operation that will run twenty four hours a day utilizing the flow of river water, will pump the water to places where it is needed to supply unlimited amounts of fresh water thereto.

A further object is to provide a river pump device that is simple and easy to use.

A still further object is to provide a river pump device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
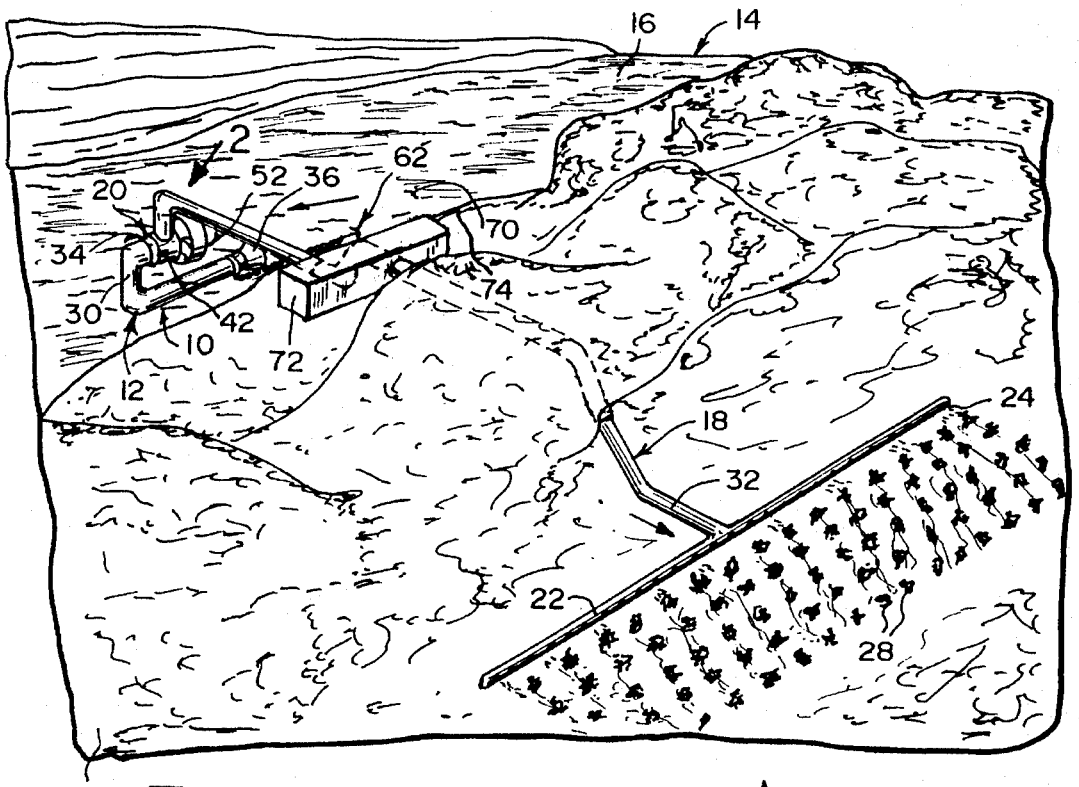
FIG. 1 is a perspective view of the instant invention in use, pumping river water to an irrigation area on land.

Turning now descriptively to the drawings, in which similar reference characters denote similar elements throughout the several views, FIGS. 1 through 6 illustrate a river pump device 10, comprising a first conduit 12 immersed in a river 14, to receive water 16 from the river 14. A second conduit 18 carries the water 16 away from the river 14. A mechanism 20 immersed in the river 14 is operable by the kinetic force of the water 16 flowing in the river 14, for moving the water 16 out of the first conduit 12 into the second conduit 18. An irrigation tube 22 is transversely coupled to a distal end of the second conduit 18. The irrigation tube 22 has a plurality of small holes 24 thereal-ong, to supply the water 16 onto dry land 26, so that vegetation 28 will thrive.

The first conduit 12 is a hooked intake pipe 30 coupled to and extending below the water moving mechanism 20. A distal free end of the intake pipe 30 faces into the direction of the flowing water 16.

The second conduit 18 is an elongated discharge pipe 32 coupled to and extending above the water moving mechanism 20. The discharge pipe 32 will divert the water 16 coming from the river 14 onto the dry land 26, via the irrigation tube 22. The water moving mechanism 20 is a water pump 34.

The intake pipe 30 includes an intake nozzle 36, having a wide mouth 38 at the distal free end thereof. An intake valve 40 is internally located in the distal free end behind the intake nozzle 36.

The water pump 34 consists of a housing 42 having an inlet port 44 connected to the first conduit 12 and an outlet port 46 connected to the second conduit 18. A rotor 48 has a shaft 50 rotatively mounted in the housing 42. A propeller unit 52 is on an end of the shaft 50 above the distal free end of the first conduit 12. The propeller unit 52 will rotate the shaft 50 by the force of the flowing water 16 to turn the rotor 48, thereby moving the water 16 through the housing 42 from the inlet port 44 to the outlet port 46.

The propeller unit 52 contains a hub 54 affixed to the end of the shaft 50. A plurality of curved blades 56 radially extend from the hub 54. A ring frame 58 is about the outer edges of the curved blades 56.

Figure 3:
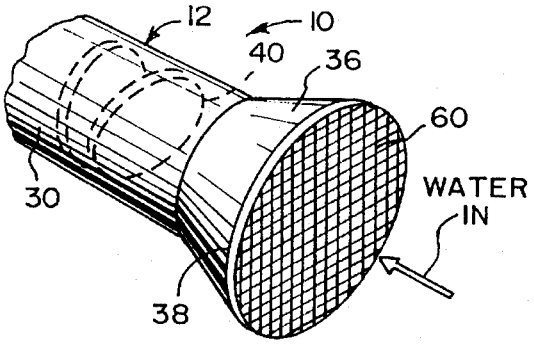
FIG. 3 is a perspective view taken in the direction of arrow 3 in FIG. 2, showing an optional filter screen at the intake nozzle.
Figure 4:
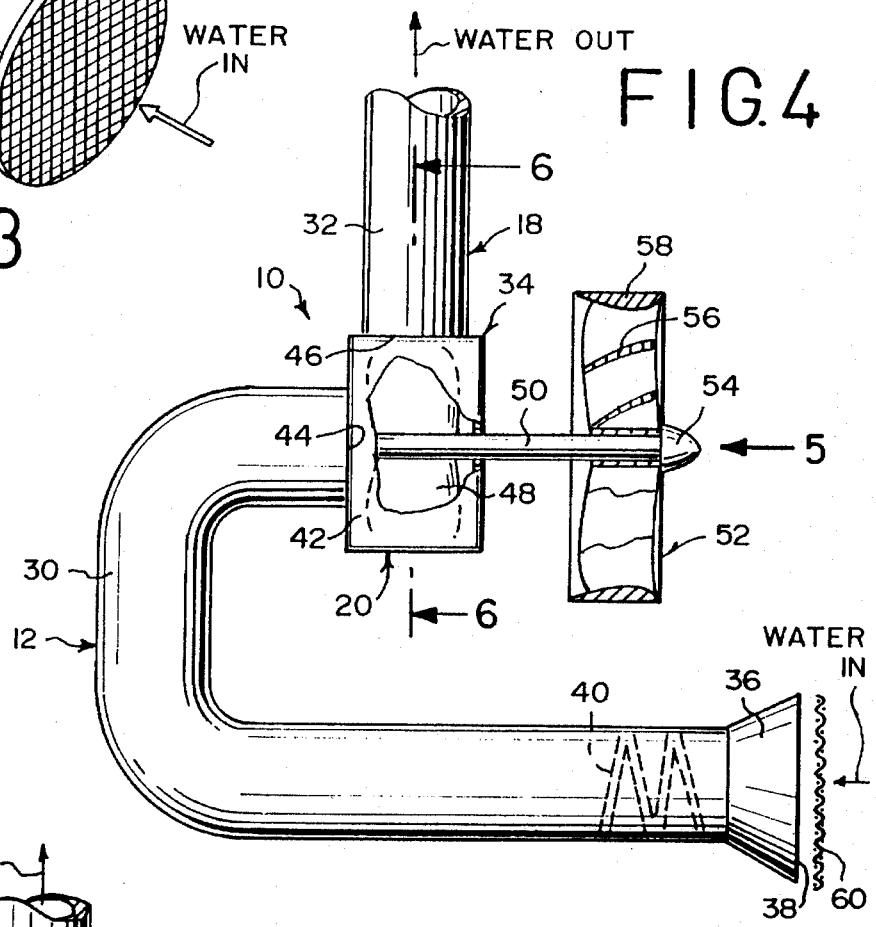
FIG. 4 is a side view with parts broken away taken in the direction of arrow 4 in FIG. 2.
Figure 5:
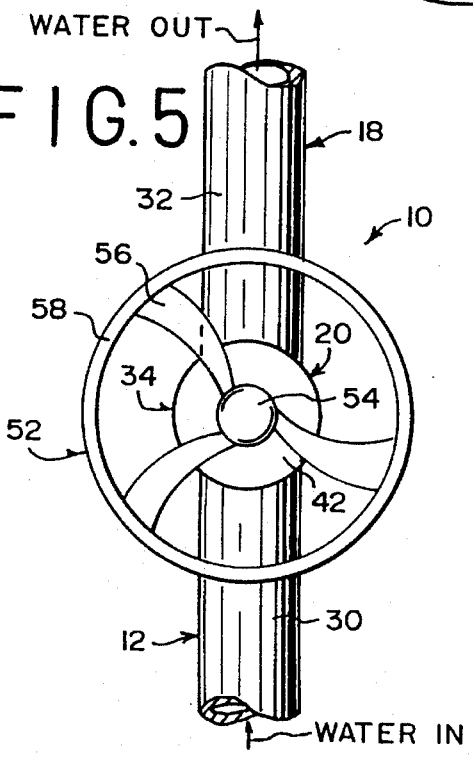
FIG. 5 is a front view with parts broken away taken in the direction of arrow 5 in FIG. 4.
Figure 6:
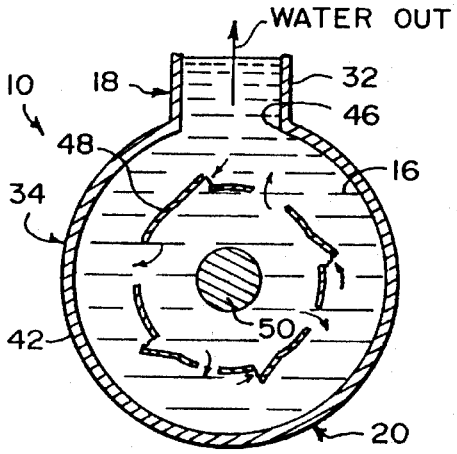
FIG. 6 is a cross sectional view taken along line 6—6 in FIG. 4.

As shown in FIGS. 3 and 4, the intake pipe 30 can further include a filter screen 60, which will fit over the wide mouth 38 of the intake nozzle 36, to prevent large objects in the river 14 from entering the intake pipe 30.

Figure 2:
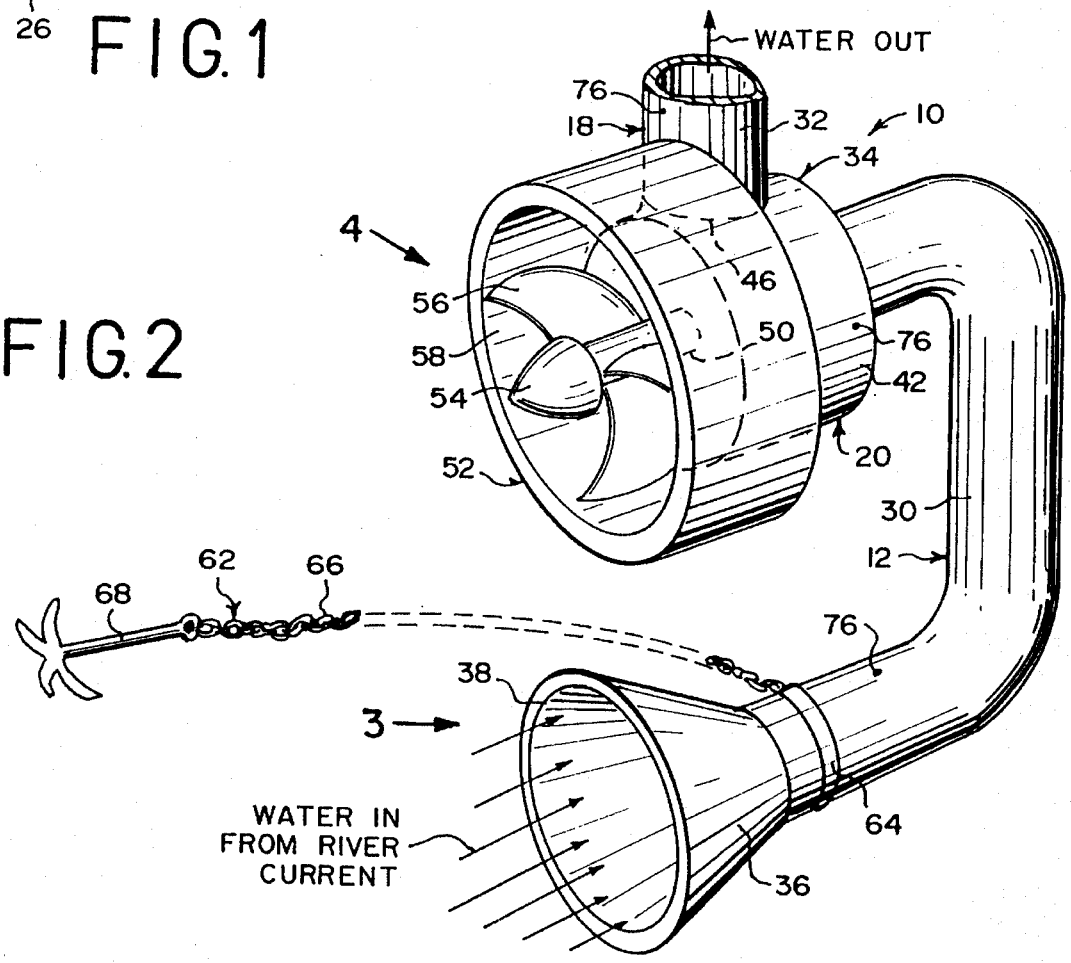
FIG. 2 is an enlarged perspective view taken in the direction of arrow 2 in FIG. 1.

An anchoring assembly 62, shown in FIGS. 1 and 2, is connected to the distal free end of the first conduit 12, to maintain the device 10 in the river 14 in a stationary position. The anchoring assembly 62 includes a collar 64, to fit about the distal free end of the first conduit 12. An elongated chain 66 is connected at a first end to the collar 64. An anchor 68 is connected to a second end of the chain 66, so that the anchor 68 can catch in the river bottom 70 to hold the first conduit 12 in place.

A small wall 72, shown in FIG. 1, is on the bank 74 of the river 14. The second conduit 18 can extend through the small wall 72, to stabilize the second conduit 18 in place between the irrigation tube 22 and the water moving mechanism 20. The first conduit 12, the second conduit 18 and the water moving mechanism 20 are fabricated out of a corrosion free durable material 76.

LIST OF REFERENCE NUMBERS

10 river pump device
12 first conduit of 10
14 river
16 water of 14
18 second conduit of 10
20 water moving mechanism of 10
22 irrigation tube of 10
24 small hole in 22
26 dry land
28 vegetation on 26
30 hooked intake pipe for 12
32 elongated discharge pipe for 18
34 water pump for 20
36 intake nozzle of 30
38 wide mouth of 36
40 intake valve of 30
42 housing of 34
44 inlet port in 42 to 12
46 outlet port in 42 to 18
48 rotor of 34
50 shaft on 48
52 propeller unit of 34
54 hub of 52
56 curved blade of 52
58 ring frame of 52
60 filter screen of 30 on 38
62 anchoring assembly on 12
64 collar of 62
66 elongated chain of 62
68 anchor of 62
70 river bottom
72 small wall
74 bank of 14

76 corrosion free durable material for 12, 18 and 20

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A river pump device comprising:

a) a first conduit immersed in a river to receive water from the river;

b) a fixed second conduit to carry the water away from the river;

c) means immersed in the river and operable by the kinetic force of the water flowing in the river, for moving the water out of said first conduit into said second conduit; and d) an irrigation tube transversely coupled to a distal end of said second conduit, said irrigation tube having a plurality of small holes therealong to supply the water onto dry land, so that vegetation will thrive; wherein said first conduit is a hooked intake pipe coupled to and extending below said water moving means, said intake pipe comprising a distal free end having a wide mouth intake nozzle facing into the direction of the flowing water.

2. A river pump device as recited in claim 1, wherein said second conduit is an elongated discharge pipe coupled to and extending above said water moving means, so that said discharge pipe will divert the water coming from the river onto the dry land, via said irrigation tube.

3. A river pump device as recited in claim 1, wherein said water moving means is a water pump.

4. A river pump device as recited in claim 3, wherein said water pump includes:

a) a housing having an inlet port connected to said first conduit and an outlet port connected to said second conduit;

b) a rotor having a shaft rotatively mounted in said housing; and c) a propeller unit on an end of said shaft above the distal free end of said first conduit, whereby said propeller unit will rotate said shaft by the force of the flowing water to turn said rotor, thereby moving the water through said housing from the inlet port to the outlet port.

5. A river pump device as recited in claim 4, wherein said propeller unit includes:

a) a hub affixed to the end of said shaft;

b) a plurality of curved blades radially extending from said hub; and c) a ring frame about the outer edges of said curved blades.

6. A river pump device as recited in claim 1, wherein said intake pipe further includes a filter screen which fits over the wide mouth of said intake nozzle, to prevent large objects in the river from entering said intake pipe.

7. A river pump device as recited in claim 1, further including a small wall on the bank of the river, so that said second conduit can extend through said small wall to stabilize said second conduit in place between said irrigation tube and said water moving means.

8. A river pump device as recited in claim 1, wherein said first conduit, said second conduit and said water moving means are fabricated out of a corrosion free durable material.

9. A river pump device as recited in claim 2, wherein said water moving means is a water pump.

10. A river pump device as recited in claim 4, wherein said water pump includes:

a) a housing having an inlet port connected to said first conduit and an outlet port connected to said second conduit;

b) a rotor having a shaft rotatively mounted in said housing; and c) a propeller unit on an end of said shaft above the distal free end of said first conduit, whereby said propeller unit will rotate said shaft by the force of the flowing water to turn said rotor, thereby moving the water through said housing from the inlet port to the outlet port.

11. A river pump device as recited in claim 10, wherein said propeller unit includes:

a) a hub affixed to the end of said shaft;

b) a plurality of curved blades radially extending from said hub; and c) a ring frame about the outer edges of said curved blades.

12. A river pump device as recited in claim 11, wherein said intake pipe further includes a filter screen which fits over the wide mouth of said intake nozzle, to prevent large objects in the river from entering said intake pipe.

13. A river pump device as recited in claim 12, further including an anchoring assembly connected to the distal free end of said first conduit, to maintain said device in the river in a substantially stationary position.

14. A river pump device as recited in claim 13, wherein said anchoring assembly includes:

a) a collar to fit about the distal free end of said first conduit;

b) an elongated chain connected at a first end to said collar; and c) an anchor connected to a second end of said chain, so that said anchor can catch in the river bottom to hold said first conduit in place.

15. A river pump device as recited in claim 14, further including a small wall on the bank of the river, so that said second conduit can extend through said small wall to stabilize said second conduit in place between said irrigation tube and said water moving means.

16. A river pump device as recited in claim 15, wherein said first conduit, said second conduit and said water moving means are fabricated out of a corrosion free durable material.

17. A river pump device comprising:

a) a first conduit immersed in a river to receive water from the river;

b) a fixed second conduit to carry the water away from the river;

c) means immersed in the river and operable by the kinetic force of the water flowing in the river, for moving the water out of said first conduit into said second conduit;

d) an anchoring assembly connected to the distal free end of said first conduit, to maintain said device in the river in a substantially stationary position, said anchoring assembly including a collar to fit about the distal free end of said first conduit; an elongated chain connected at a first end to said collar; and an anchor connected to a second end of said chain, so that said anchor can catch in the river bottom to hold said first conduit in place; and e) an irrigation tube transversely coupled to a distal end of said second conduit, said irrigation tube having a plurality of small holes therealong to supply the water onto dry land, so that vegetation will thrive.

* * * * *